United States Patent [19]

Katayama

[11] Patent Number: 4,497,721

[45] Date of Patent: Feb. 5, 1985

[54] REFRIGERATOR OIL COMPOSITION

[75] Inventor: Takao Katayama, Ichihara, Japan

[73] Assignee: Idemitsu Kosan Company Limited, Tokyo, Japan

[21] Appl. No.: 549,588

[22] Filed: Nov. 7, 1983

[30] Foreign Application Priority Data

Nov. 17, 1982 [JP] Japan ..... 57-200280
Dec. 16, 1982 [JP] Japan ..... 57-220604

[51] Int. Cl.[3] ..... C10M 3/18; C10M 5/12
[52] U.S. Cl. ..... 252/56 R; 252/52 R
[58] Field of Search ..... 252/52 R, 56 R, 68; 549/352

[56] References Cited

U.S. PATENT DOCUMENTS 3,264,216 8/1966 Rockett ..... 252/56 R
3,862,265 1/1975 Steinkamp et al. ..... 252/56 R
4,123,368 10/1978 Leister et al. ..... 252/56 R

*Primary Examiner*—William R. Dixon, Jr.
*Assistant Examiner*—C. Johnson
*Attorney, Agent, or Firm*—Frishauf, Holtz, Goodman & Woodward

[57] ABSTRACT

A refrigerator oil composition is described, comprising: (1) at least one of mineral oil and synthetic oil and (2) at least one of (a) 15-crown-5, (b) a derivative of 15-crown-5, and (c) a glycidyl compound represented by the general formula:

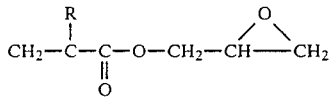

(wherein R is hydrogen or an alkyl group containing from 1 to 5 carbon atoms). This composition exhibits high stability when in contact with halogen-containing refrigerants and is limited in the formation of hydrogen chloride, for example, resulting from its reaction with the halogen-containing refrigerants. Thus the refrigerator oil composition of the invention is useful as a lubricant for refrigerators.

5 Claims, No Drawings

REFRIGERATOR OIL COMPOSITION

BACKGROUND OF THE INVENTION

The present invention relates to a refrigerator oil composition. More particularly, the present invention relates to a refrigerator oil composition which is thermally and chemically stable in the presence of halogen-containing refrigerants and further which has superior lubricating and sealing properties.

A base oil derived from naphthenic crude oil of high quality has heretofore been widely used as a refrigerator oil because of its superior characteristics. However, the naphthenic crude oil is shortage and tends to gradually decrease in the world, and it is said that, in particular, special naphthenic crude oil for use in the preparation of a refrigerator oil will be exhausted in the future. Under these circumstances, it has become increasingly difficult to ensure such naphthenic crude oil. It is therefore inevitably necessary to make good use of low quality naphthenic base oil containing relatively large amounts of impurities, paraffinic base oil, and other synthetic base oils.

The main characteristics generally required for the usual refrigerator oil are: (1) it has an appropriate viscosity; (2) it is superior in low temperature performance; (3) the critical temperatures at which it is dissolved in refrigerants are low; (4) it produced good results in the sealed tube test; and (5) it is superior in thermal stability, i.e., produces good results in the panel coking test.

The most serious problem encountered in making use of low quality naphthenic base oil or paraffinic base oil as a refrigerator oil is that the stability of the refrigerator oil as prepared therefrom is very poor when brought into contact with halogen-containing refrigerants; that is, its ability to inhibit the formation of hydrogen halide, such as hydrogen chloride, resulting from the reaction with the halogen-containing refrigerants is very low.

To improve such poor stability, various stabilizers have been proposed, including glycidyl ether type epoxy compounds such as phenyl glycidyl ether and octylepoxy stearate, and epoxidized fatty acid monoesters (see Japanese Patent Application Laid-Open Nos. 132,005/1978, 140,469/1978 and 58,298/1980, and U.S. Pat. No. 2,582,084).

The stability of the refrigerator oil has not yet become satisfactory even by using such stabilizers, and it is now very difficult to produce a high performance refrigerator oil from base oils other than high quality naphthenic base oil.

SUMMARY OF THE INVENTION

An object of the invention is to provide a stabilizer which permits the production of high performance refrigerator oil from low quality naphthenic base oil or paraffinic base oil.

Another object of the invention is to provide a refrigerator oil composition showing high stability even when in contact with halogen-containing refrigerants.

The present invention relates to a refrigerator oil composition comprising:

(1) mineral oil, synthetic oil or a mixture thereof; and (2) (a) 15-crown-5, (b) a derivative of 15-crown-5, (c) a glycidyl compound represented by the general formula (I):

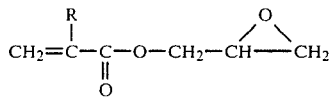

(I)

(wherein R is a hydrogen atom or an alkyl group containing from 1 to 5 carbon atoms), or (d) a mixture thereof.

DETAILED DESCRIPTION OF THE INVENTION

Component (1) of the composition of the invention is mineral oil, synthetic oil or a mixture thereof, and constitutes a major portion of the composition. Various kinds of mineral oil or synthetic oil can be used, but Component (1) preferably has a viscosity of from 1 to 50 centistokes (cst) at 100 degrees centigrade (°C.).

Typical examples of mineral oils include lubricating oil fractions of naphthenic, intermediate or paraffinic mineral oils, and high aromatic fractions obtained by decomposition of these mineral oils. Typical examples of synthetic oils include polyolefin oils such as straight alkylbenzene, branched alkylbenzene and polybutene, alkylnaphthalene, ester oil, and polyglycol oil. These oils can be used singly or in combination with each other. It is preferred to use mineral oil and/or synthetic oil which have been subjected to clay treatment.

Component (2) of the composition in the present invention acts as a stabilizer. Addition of this Component (2) as a stabilizer permits the production of high performance refrigerator oil from mineral oil and/or synthetic oil which are inherently unsuitable for use as refrigerator oil. This is one of the great features of the present invention.

Component (2) is, as described above, (a) 15-crown-5, (b) its derivative, (c) a compound represented by the general formula (I), or (d) a mixture thereof.

Compound (a), 15-crown-5, is represented by the formula (II):

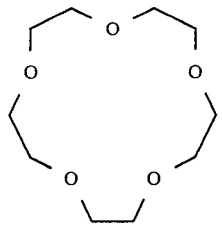

(II)

As Compound (b), 15-crown-5-derivative, various compounds are available. Typical examples are shown below.

Benzo-15-crown-5 represented by the formula (III):

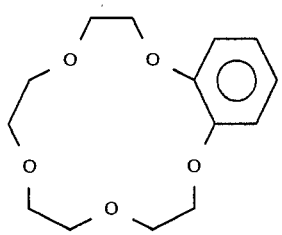

(III)

Cyclohexyl-15-crown-5 represented by the formula (IV):

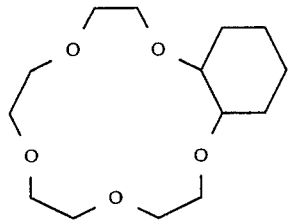

(IV)

Tert-butylbenzo-15-crown-5 represented by the formula (V):

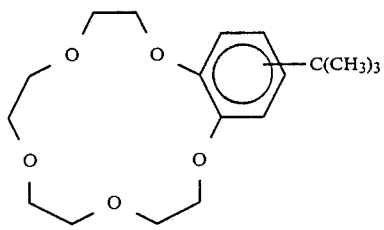

(V)

These compounds can be prepared by known procedures and are now commercially available. 15-crown-5 is manufactured by Nippon Soda Co., Ltd., and benzo-15-crown-5, cyclohexyl-15-crown-5, and tert-butylbenzo-15-crown-5 are available as the products from PCR Research Chemicals Inc.

Compound (c) is a glycidyl compound represented by the general formula (I). The alkyl group containing from 1 to 5 carbon atoms, as indicated by R in the general formula (I), includes a methyl group, an ethyl group, a normal-propyl group, an iso-propyl group, a normal-butyl group, a sec-butyl group, a tert-butyl group, a normal-pentyl group, a 2-methylbutyl group, a 3-methylbutyl group, and a 2,2-dimethylpropyl group, and also includes alkyl groups containing an unsaturated bond.

These glycidyl compounds can be prepared, for example, by reacting α-epichlorohydrin with fatty acid sodium salts

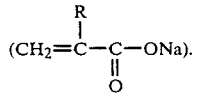

Suitable examples of the glycidyl compounds represented by the general formula (I) are glycidyl acrylate, glycidyl methacrylate, glycidyl ethylacrylate, glycidyl propylacrylate, glycidyl isopropylacrylate, glycidyl butylacrylate, glycidyl sec-butylacrylate, and glycidyl tert-butylacrylate. Of these compounds, glycidyl acrylate and glycidyl methacrylate are preferred since they produce a refrigerator oil which is greatly improved in stability when in contact with halogen-containing refrigerants.

Compound (d) is a mixture comprising two or more of Compounds (a), (b) and (c). That is, as Component (2), Compounds (a), (b) and (c) can be used singly or in combination with each other.

The composition of the invention is prepared by adding Component (2) to Component (1). The amount of Component (2) being added is not critical, but it is usually added in an amount of from 0.001 to 10 parts by weight, preferably from 0.01 to 5 parts by weight, per 100 parts by weight of Component (1).

The refrigerator oil composition of the invention is useful as a lubricant for refrigerators. This composition has high stability when in contact with halogen-containing refrigerants, inhibiting the formation of hydrogen halide, such as hydrogen chloride, for example, whereby the interior of refrigerators can be prevented from corroding. Addition of the stabilizer as used herein permits the production of high stability and high performance refrigerator oil from many base oils other than high quality naphthenic base oil which are inherently unsuitable for use as refrigerator oils. Hence the present invention permits effective utilization of resources and its economic advantage is very great.

The present invention is described in greater detail with reference to the following Examples and Comparative Examples.

EXAMPLES 1 TO 16

A series of refrigerator oil compositions were prepared by blending the low quality naphthenic or synthetic base oils and predetermined amounts of stabilizers as described in Table 1. These compositions were subjected to the sealed tube test as described hereinafter. The results are shown in Table 1.

COMPARATIVE EXAMPLES 1 TO 7

A series of refrigerator oil compositions were prepared from low quality naphthenic base oil or alkylbenzene (soft type) with or without addition of predetermined amounts of stabilizers in the formulations as described in Table 1. These compounds were subjected to the same sealed tube test as in Examples 1 to 16. The results are shown in Table 1.

Sealed Tube Test

Tube: 10-milliliter Pyrex glass ampule (pressure resistance: 20 kilogram force per square centimeter (kg f/cm$^2$))

Temperature: 175° C.

Time: 250 hours

Refrigerant: Fron ($CF_2Cl_2$) (trade name: Daifron-12, produced by Daikin Kogyo Co., Ltd.)

Catalyst: Copper, iron and aluminum (diameter: 1.6 millimeters; length: 40 millimeters)

Four milliliters of refrigerator oil composition prepared in the Examples or the Comparative Examples, 2 grams of the refrigerant, and a small amount of the catalyst were placed in the tube. Then, the tube was sealed to be maintained at 175° C. for 250 hours.

After the sealed tube test, the amount of hydrogen chloride formed, discoloration of oil, and appearance of the catalyst were examined, and the results are shown in Table 1.

TABLE I

| Run No. | Base Oil Type | Base Oil Amount (parts by weight) | Stabilizer Type | Stabilizer Amount (parts by weight) | Sealed Tube Test: Amount of Hydrogen Chloride Formed (milligrams per 4 milliliters)*1 | Sealed Tube Test: Discoloration of Oil | Sealed Tube Test: Appearance of Catalyst |
|---|---|---|---|---|---|---|---|
| Example 1 | Naphthenic base oil*2 | 100 | 15-Crown-5 | 0.01 | 3.1 | Pale Yellow | Slight discoloration of Fe and Cu |
| Example 2 | Naphthenic base oil*2 | 100 | " | 0.1 | 0.8 | No discoloration | Good |
| Example 3 | Naphthenic base oil*2 | 100 | " | 1.0 | 0.6 | " | " |
| Example 4 | Naphthenic base oil*2 | 100 | " | 5.0 | 0.5 | " | " |
| Example 5 | Alkylbenzene*3 (soft type) | 100 | " | 0.1 | 0.4 | " | " |
| Example 6 | Naphthenic base oil*2 | 100 | Benzo-15-crown-5 | 0.1 | 1.2 | " | " |
| Example 7 | Naphthenic base oil*2 | 100 | Cyclohexyl-15-crown-5 | 0.1 | 1.4 | " | " |
| Example 8 | Naphthenic base oil*2 | 100 | Glycidyl methacrylate | 0.01 | 2.3 | Pale yellow | " |
| Example 9 | Naphthenic base oil*2 | 100 | Glycidyl methacrylate | 0.1 | 0.1 | No discoloration | " |
| Example 10 | Naphthenic base oil*2 | 100 | Glycidyl methacrylate | 1.0 | 0.05 | " | " |
| Example 11 | Naphthenic base oil*2 | 100 | Glycidyl methacrylate | 5.0 | 0.04 | " | " |
| Example 12 | Naphthenic base oil*2 | 100 | Glycidyl acrylate | 0.1 | 0.2 | " | " |
| Example 13 | Naphthenic base oil*2 | 100 | Glycidyl acrylate | 1.0 | 0.1 | " | " |
| Example 14 | Naphthenic base oil*2 | 100 | Glycidyl ethylacrylate | 1.0 | 0.08 | " | " |
| Example 15 | Naphthenic base oil*2 | 100 | Glycidyl propylacrylate | 1.0 | 0.1 | No discoloration | Good |
| Example 16 | Alkylbenzene*3 (soft type) | 100 | Glycidyl methacrylate | 0.1 | 0.1 | " | " |
| Comparative Example 1 | Naphthenic base oil*2 | 100 | — | — | 7.0 | Black brown | Formation of sludge on the catalyst |
| Comparative Example 2 | Alkylbenzene*3 (soft type) | 100 | — | — | 3.4 | Dark yellow | Formation of sludge on the catalyst |
| Comparative Example 3 | Naphthenic base oil*2 | 100 | Phenyl glycidyl ether | 0.1 | 6.2 | Black brown | Formation of sludge on the catalyst |
| Comparative Example 4 | Naphthenic base oil*2 | 100 | 1,2-Epoxy-4-ethylbenzene | 0.1 | 6.8 | " | Formation of sludge on the catalyst |
| Comparative Example 5 | Naphthenic base oil*2 | 100 | 18-Crown-6 | 0.1 | 6.7 | " | Formation of sludge on the catalyst |
| Comparative Example 6 | Naphthenic base oil*2 | 100 | Dicyclohexyl-18-crown-6 | 0.1 | 6.2 | " | Formation of sludge on the catalyst |
| Comparative Example 7 | Naphthenic base oil*2 | 100 | Dibenzo-24-crown-8 | 0.1 | 7.0 | " | Formation of sludge on the catalyst |

Note:
*1The ampule was freezed with liquid nitrogen and then opened in one end. The opened end was dipped in 100 milliliters of distilled water to allow hydrogen chloride generated to be absorbed in the distilled water. This distilled water was titrated with a 1/10 normal aqueous solution of potassium hydroxide.
*2MC Oil N-90 (produced by Idemitsu Kosan Co., Ltd.)
Sulfur content: 0.5% by weight
Viscosity (at 100° C.): 9 centistokes
Ring analysis value:% $C_A$ 6.5, % $C_N$ 39.0, % $C_P$ 54.5
Treated with 8% by weight clay.
*3ABH-SH (Mitsubishi Yuka Co., Ltd.)
Specific gravity (15/4° C.): 0.89
Viscosity (at 100° C.): 4.5 centistokes
Pour point: −40° C. or less

What is claimed is:

1. A refrigerator oil composition comprising:

(1) mineral oil, synthetic oil or a mixture thereof; and (2) (a) 15-crown-5, (b) a derivative of 15-crown-5, (c) a glycidyl compound represented by the general formula:

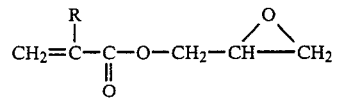

(wherein R is a hydrogen atom or an alkyl group containing from 1 to 5 carbon atoms), or (d) a mixture thereof.

2. The composition as claimed in claim 1, wherein the amount of Component (2) added is from 0.001 to 10 parts by weight per 100 parts by weight of Component (1).

3. The composition as claimed in claim 1, wherein component (2) is a derivative of 15-crown-5 selected from the group consisting of benzo-15-crown-5, cyclohexyl-15-crown-5 and tert-butylbenzo-15-crown-5.

4. The composition as claimed in claim 1, wherein component (2) is a glycidyl compound selected from the group consisting of glycidyl acrylate, glycidyl methacrylate, glycidyl ethylacrylate, glycidyl propylacrylate, glycidyl isopropylacrylate, glycidyl butylacrylate, glycidyl sec-butylacrylate, and glycidyl tert-butylacrylate.

5. The composition as claimed in claim 1, wherein the viscosity of Component (1) as determined at 100° C. is from 1 to 50 centistokes.

* * * * *